US010233057B2

(12) United States Patent
Saker et al.

(10) Patent No.: US 10,233,057 B2
(45) Date of Patent: Mar. 19, 2019

(54) ANTI-TWO-BLOCK SENSING APPARATUS AND METHOD

(71) Applicant: Keppel Offshore & Marine USA, Inc., Houston, TX (US)

(72) Inventors: Timothy Saker, Longview, TX (US); Timothy Williams, Longview, TX (US)

(73) Assignee: KEPPEL LETOURNEAU USA, INC., Houston, TX (US)

( * ) Notice: Subject to any disclaimer, the term of this patent is extended or adjusted under 35 U.S.C. 154(b) by 377 days.

(21) Appl. No.: 15/011,254

(22) Filed: Jan. 29, 2016

(65) Prior Publication Data

US 2017/0217738 A1 Aug. 3, 2017

(51) Int. Cl.

*B66C 13/50* (2006.01)
*B66C 13/46* (2006.01)
*B66C 13/23* (2006.01)

(52) U.S. Cl.

CPC ..... *B66C 13/50* (2013.01); *B66C 13/23* (2013.01); *B66C 13/46* (2013.01); *B66C 2700/084* (2013.01)

(58) Field of Classification Search

CPC ..... B66C 13/16; B66C 13/23; B66C 13/46; B66C 13/50; B66C 23/88; B66C 15/00; B66C 2700/084; B66D 1/54

USPC ..... 212/281

See application file for complete search history.

(56) References Cited

U.S. PATENT DOCUMENTS 3,924,752 A 12/1975 Hoofnagle
4,067,447 A * 1/1978 Goss ..... B66C 13/50 212/281
4,424,909 A 1/1984 Bergeron
4,535,899 A 8/1985 Bergeron
5,263,660 A 11/1993 Brozik
5,581,256 A 12/1996 McEwan
6,068,145 A 5/2000 Luke
6,343,703 B1 2/2002 Fleagle et al.
6,549,139 B2 4/2003 Shaw, Jr.
6,744,372 B1 6/2004 Shaw et al.
6,894,621 B2 5/2005 Shaw (Continued)

FOREIGN PATENT DOCUMENTS

JP 06-271282 A 9/1994
WO WO-2013020259 A1 * 2/2013 ..... B66C 13/50

OTHER PUBLICATIONS

International Search Report and Written Opinion issued for International patent application No. PCT/US2017/014525, May 2, 2017, 15 pages.

(Continued)

*Primary Examiner* — Michael R Mansen
*Assistant Examiner* — Juan J Campos, Jr.
(74) *Attorney, Agent, or Firm* — Duane Morris LLP

(57) ABSTRACT

Various hoisting systems with anti-two-block sensing devices are provided. In one embodiment, an apparatus includes a hoisting system having a hoisting line, a sleeve positioned on the hoisting line, and an anti-two-block sensing device installed about the hoisting line so as to allow the hoisting line to move through the anti-two-block sensing device. The anti-two-block sensing device includes a detector positioned to detect a sleeve component when the sleeve is present within the anti-two-block sensing device. Additional systems, devices, and methods are also disclosed.

18 Claims, 8 Drawing Sheets

(56) References Cited

U.S. PATENT DOCUMENTS

| | | | | |
|---|---|---|---|---|
| 2011/0187548 | A1* | 8/2011 | Maynard | B66C 15/045 340/685 |
| 2013/0103271 | A1* | 4/2013 | Best | G06F 19/00 701/50 |
| 2014/0027401 | A1* | 1/2014 | Ilaka | B66C 13/16 212/276 |
| 2014/0081536 | A1 | 3/2014 | Maynard et al. | |
| 2015/0161872 | A1* | 6/2015 | Beaulieu | B66C 13/40 340/686.6 |
| 2017/0217739 | A1 | 8/2017 | Williams et al. | |

OTHER PUBLICATIONS

International Search Report and Written Opinion issued for International patent application No. PCT/US2017/014522, May 12, 2017, 14 pages.

"Wylie R140: R140 Hardwired Anti-Two-Block System," brochure, undated, one page, published by Crane Warning Systems Atlanta (available at http://www.craneindicators.com/R140_wired_ATB/R140.pdf, accessed Jan. 22, 2016).

"Electric Anti Two-Block Device," brochure, dated Aug. 4, 2015, two pages, published by BWB Controls, Inc. (available at http://www.bwbcontrols.com/assets/cbsdeg%20080515.pdf, accessed Jan. 22, 2016).

Williams et al., U.S. Appl. No. 15/011,267, filed Jan. 29, 2016.

* cited by examiner

ANTI-TWO-BLOCK SENSING APPARATUS AND METHOD

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Offshore drilling platforms often include hoisting systems for raising and lowering equipment. In some instances, these hoisting systems take the form of cranes used to load and unload equipment from an offshore platform. Of course, cranes and other hoisting systems can be used onshore as well. Cranes often include hoisting lines that are spooled from drums, reeved over sheaves in upper blocks at fixed locations in booms of the cranes (e.g., at the ends of the booms), and are connected to loads via lower, traveling blocks (or hook assemblies) at the ends of the hoisting lines. When raising connected loads with cranes, care is taken to avoid contact between the upper and lower blocks. Such contact, which is referred to as two-blocking, can interfere with crane operation and lead to failure of a hoisting line or disconnection of the suspended load from the hoisting line. Various anti-two-block sensing devices have been used on cranes to help avoid two-blocking.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

At least some embodiments of the present disclosure generally relate to anti-two-block safety systems intended to warn or stop hoisting or crane motion that would cause a two-block condition between a traveling hook block and an upper block of a crane. In certain embodiments, an anti-two-block sensing device includes a chandelier that can be hung below an upper block of a crane and can receive the hoisting line. The sensing device in at least one embodiment includes a trigger assembly for detecting an actuator coupled to the hoisting line and raised into contact with the trigger assembly. In one embodiment, the sensing device has a low-maintenance design devoid of seals, springs, lubricants, and precision sliding components. A sensing cap having proximity sensors or other detectors can be mounted on the chandelier for detecting the approach of the lower block toward the upper block and triggering alerts or preventive measures to avoid two-blocking.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
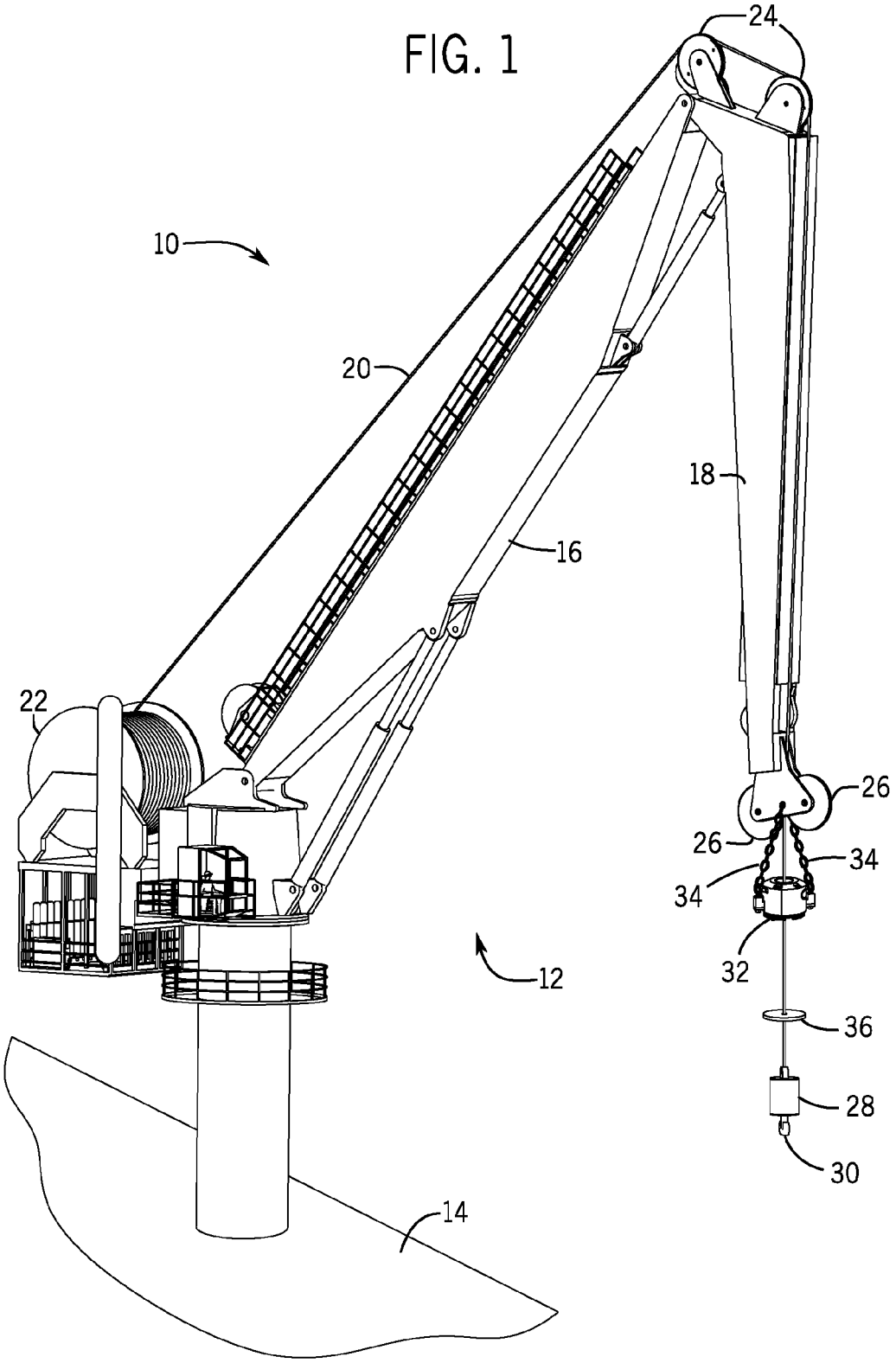
FIG. 1 generally depicts a hoisting system in the form of a crane having an anti-two-block sensing apparatus in accordance with one embodiment of the present disclosure.

Turning now to the present figures, a hoisting system 10 is illustrated in FIG. 1 in accordance with one embodiment. In this example, the hoisting system 10 is embodied in a crane 12, but the hoisting system 10 could take other forms in different embodiments and could be provided as an electric or hydraulic hoisting system. The crane 12 is shown in FIG. 1 as a pedestal crane mounted on a deck 14. The deck 14 is part of a drilling rig (e.g., a jackup rig, a drillship, or a semi-submersible drilling rig) in certain embodiments.

The depicted crane 12 is a knuckle-jib crane having a boom with a main beam 16 connected to a second beam 18. The illustrated system 10 includes a hoisting line 20 reeled out from a rotatable drum 22 on the crane 12. The hoisting line 20 is reeved through sheaves 24 and 26, and a hook assembly 28 with a hook 30 on the end of the hoisting line 20 is used to connect the hoisting line 20 to a load (e.g., supplies or equipment to be lifted by the crane 12). Once connected, the hoisting line 20 can be reeled in or reeled out from the drum 22 to raise or lower the load. Any suitable hoisting line 20 could be used with the hoisting system 10, such as a wire rope, a fiber rope, or a metal cable.

The hoisting system 10 includes an anti-two-block sensing device 32 intended to detect when the hook 30 (or other moving component coupled to the hoisting line 20) reaches a predetermined distance from the boom tip of the crane 12. In the presently depicted embodiment, the anti-two-block sensing device 32 is suspended from the end of the boom of the crane 12 via chains 34, although the sensing device 32 could instead be suspended with cables or in some other suitable manner. The hoisting line 20 extends downwardly from the end of the boom through the sensing device 32 to the hook assembly 28. An actuator 36 (e.g., a strike plate) is coupled to the hoisting line 20 for engaging a trigger of the sensing device 32, as discussed in greater detail below. In some hoisting systems, the hoisting line 20 will move through the sensing device 32; in others, the hoisting line 20 in the sensing device 32 will remain stationary, while the actuator 36 is a traveling block or other component that will move relative to the sensing device 32. Although the use of the sensing device 32 with a jib crane is generally depicted in FIG. 1, it will be appreciated that the sensing device 32 could be used with other cranes or hoisting systems in full accordance with the present techniques to reduce or avoid two-blocking in such other systems.

Figure 2:
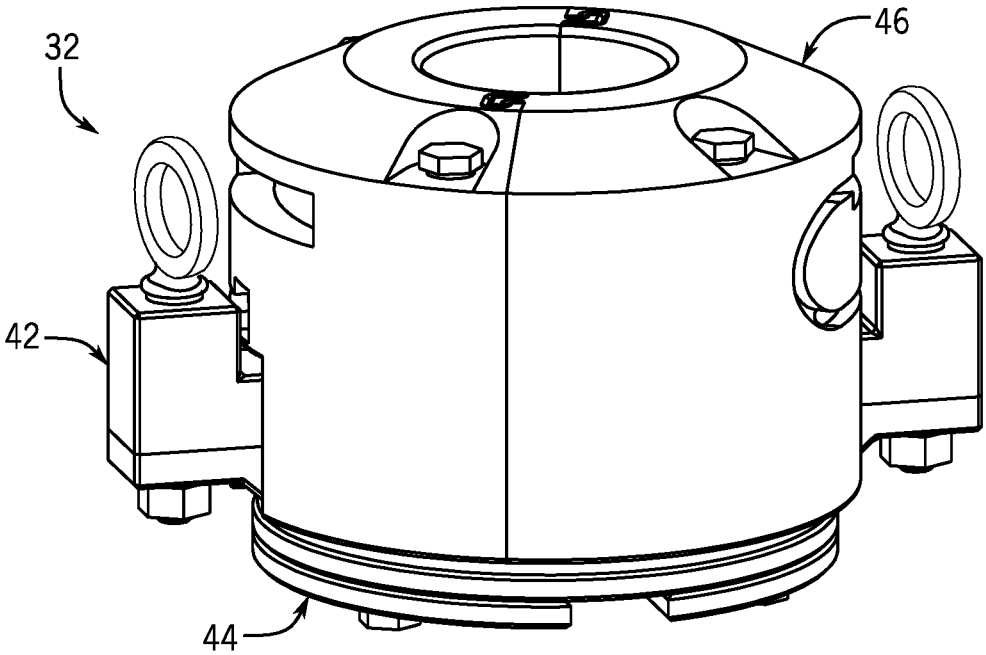
FIGS. 2 and 3 are perspective views of an anti-two-block sensing device of the apparatus of FIG. 1, which is shown as having a cap mounted to a main body with a lower trigger assembly in accordance with one embodiment.
Figure 3:
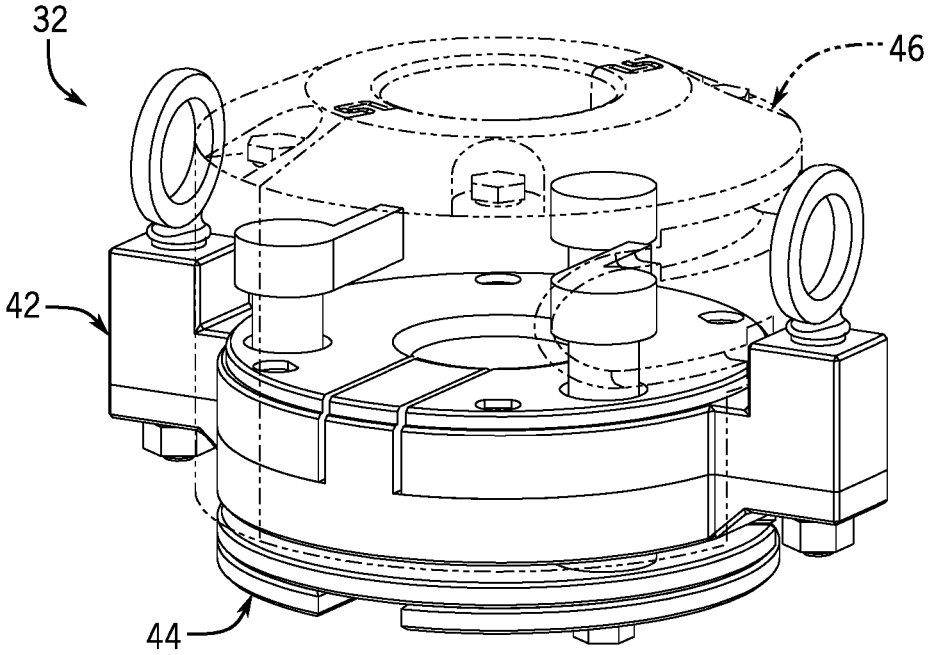

The anti-two-block sensing device 32 is illustrated in greater detail in FIGS. 2 and 3. As shown here, the sensing device 32 includes a main body 42, with a trigger device 44 coupled below the main body 42 and a cap 46 mounted over the main body 42. The cap 46 is drawn in phantom in FIG. 3 to show certain additional details regarding the main body 42 and trigger device 44, which may be better appreciated with reference to FIGS. 4-6.

Figure 4:
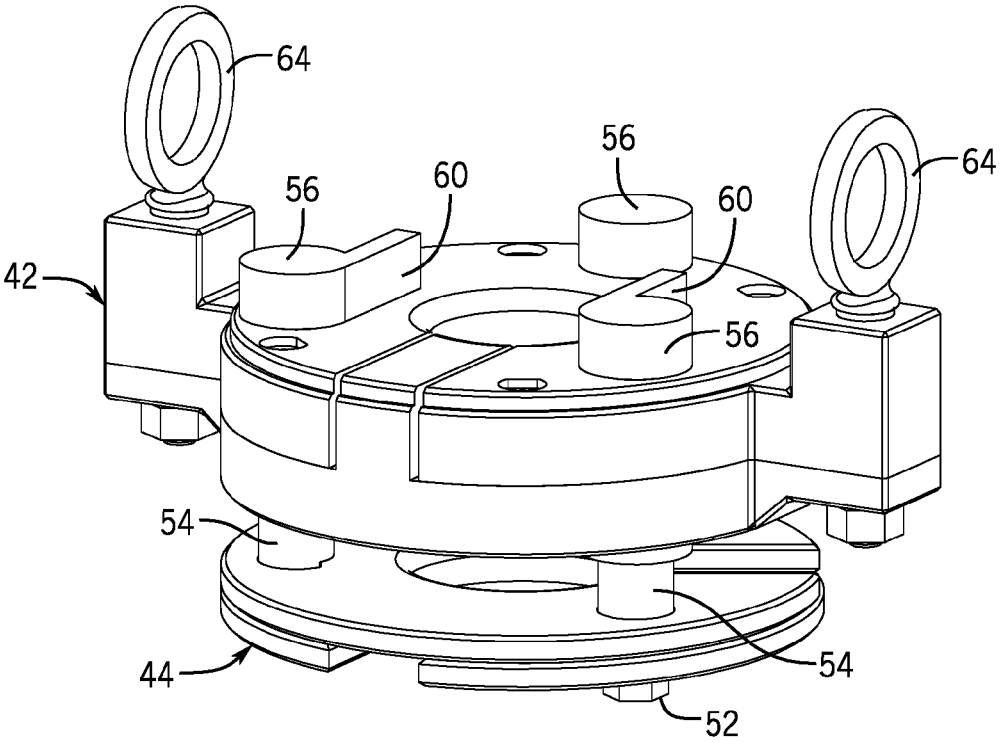
FIGS. 4 and 5 are perspective views of the main body and lower trigger assembly of the sensing device and show the lower trigger assembly in resting and actuated positions in accordance with one embodiment.
Figure 5:
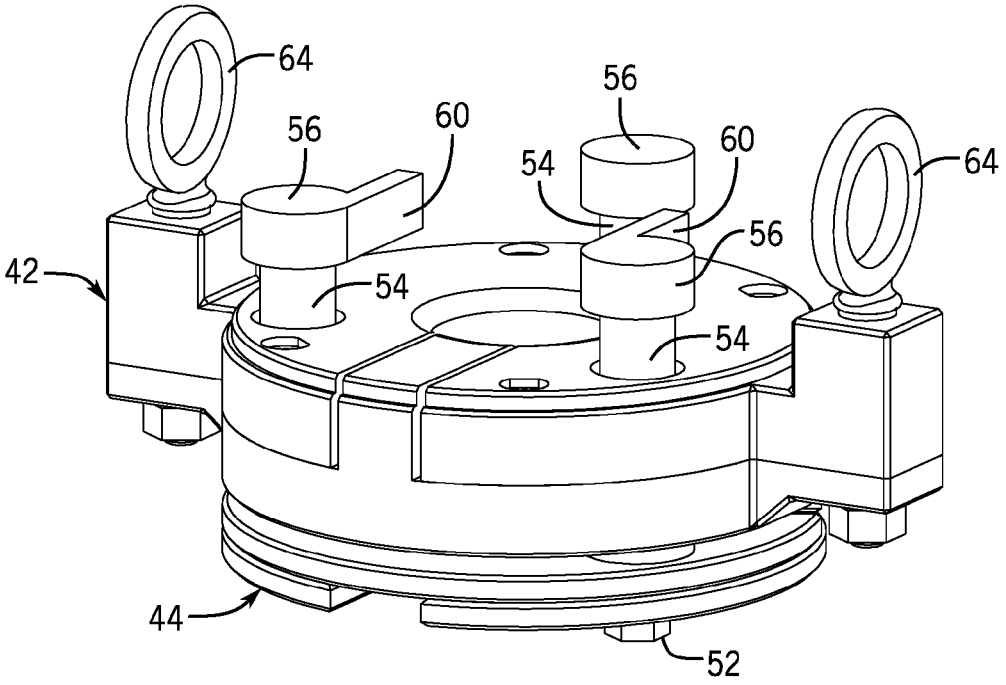

The main body 42 (which may also be referred to as a chandelier) can be suspended from a crane via lifting eyes 64. The trigger device 44 is coupled to the main body 42 via links that allow the trigger device 44 to freely move between a resting position, as shown in FIG. 4, and an actuated position, as shown in FIG. 5. More specifically, in the resting position of FIG. 4, the trigger device 44 is suspended from the main body 42 via links including connecting bolts 52, sleeves 54, and heads 56. In some embodiments, the heads 56 are integral with the sleeves 54, but the heads 56 and sleeves 54 could be separate components in other instances. Although other arrangements are envisioned, in the presently depicted embodiment the links extend through the main body 42 and the trigger device 44 is suspended from the main body 42 through engagement of the heads 56 with an upper surface of the main body 42. The links are rigidly coupled to the trigger device 44, but are free to move a certain distance in the axial direction with respect to the main body 42. When the trigger device 44 is driven upwardly toward the main body 42 (e.g., when the hoisting line is reeled in and the actuator 36 coupled to the hoisting line lifts the trigger device 44 toward the main body 42), the links move with the trigger device and the heads 56 lift away from the upper surface of the main body 42, as depicted in FIG. 5.

The anti-two-block sensing device 32 includes one or more detectors for identifying movement of the trigger device 44. More particularly, in at least some embodiments the sensing device 32 includes a proximity sensor for detecting movement of a link caused by movement of the trigger device 44 toward the main body 42 (e.g., when driven upwardly by the actuator 36). If the sensing device 32 includes a cap 46 mounted on the main body 42, the proximity sensor or other detector can be installed in the cap 46 (e.g., as detector 128 of FIG. 9). In other embodiments, such as those in which the cap 46 is omitted from the sensing device 32, the proximity sensor or other detector can be provided elsewhere (e.g., mounted on the main body 42).

Figure 6:
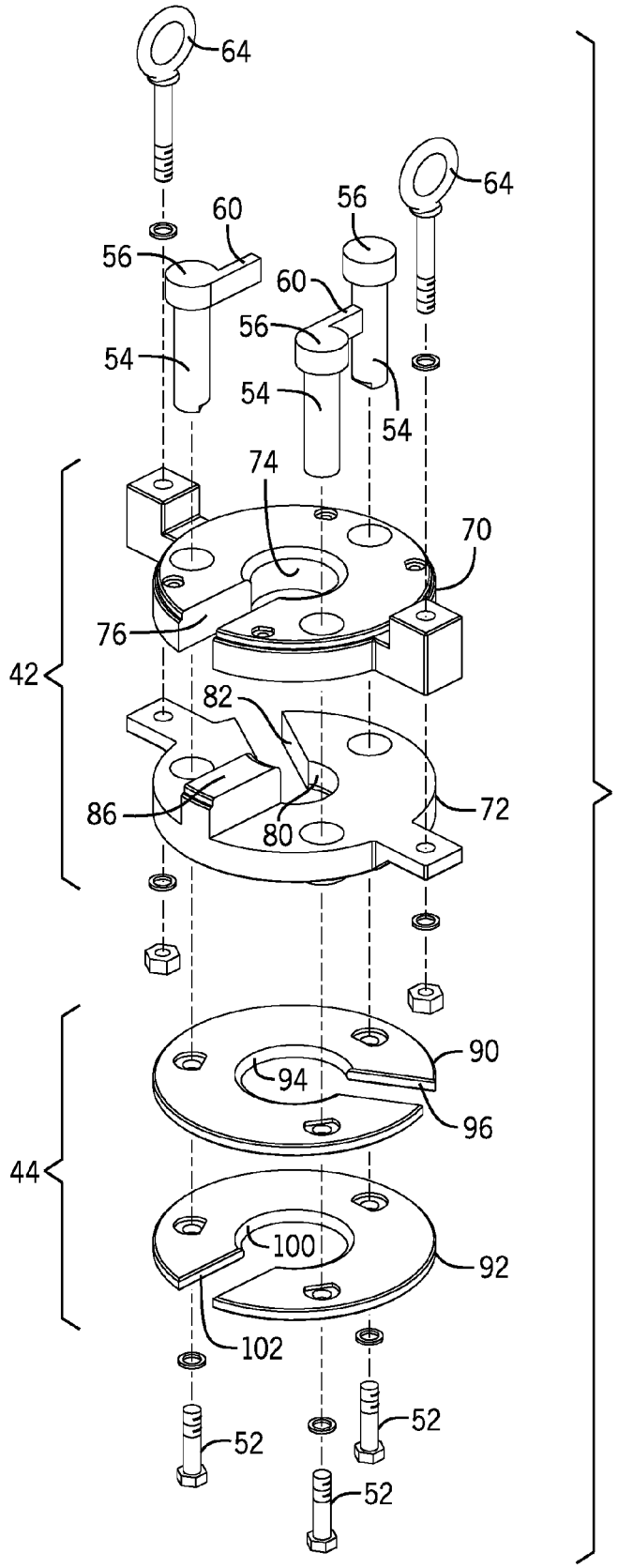
FIG. 6 is an exploded view of the main body and lower trigger assembly of the sensing device in accordance with one embodiment.

Two of the heads 56 are shown in FIGS. 4-6 as having proximity targets 60 in the form of outwardly extending tabs to be detected by a pair of proximity sensors, but targets 60 can be provided in any other suitable form. Two detectors (e.g., two detectors 128 at opposite sides of the cap 46) can be positioned with respect to the targets 60 such that each of the targets 60 lie within the detection zone of one of the detectors when the trigger device 44 is in its lowered, resting position during normal operation of the hoisting system with the hook sufficiently spaced from the boom of the crane. When the actuator 36 (e.g., strike plate, traveling block, or some other component) coupled to the hoisting line 20 is raised into contact with and then lifts the trigger device 44, the links move upwardly and the targets 60 rise out of the detection zones (which are also referred to as the sensing areas) of the detectors. In such instances, the detectors can signal to a controller that the targets have moved out of the detection zones and, as discussed below, the controller can automatically stop the hoisting motion or crane movement (to avoid continuing to a two-block condition) or notify an operator (e.g., by triggering a warning alarm on a control panel).

In at least some embodiments, the detectors continuously (or continually) sense the targets 60 during normal hoisting operations (e.g., while moving the hoisting line 20 through the sensing device 32) until the trigger device 44 is moved through contact with the actuator 36, which causes lifting of the targets 60 as described above. Further, in this arrangement improper adjustment (or malfunctioning) of the detectors can be indicated by the inability of the detectors to "see" the targets 60 during normal conditions (i.e., in which the trigger device 44 has not been actuated). This is in contrast to other possible arrangements in which the detectors are used to detect movement of objects into the detection zone of the sensors upon actuation of the trigger device 44.

Any suitable detectors could be used for sensing the presence or absence of the targets 60. In at least some instances, the detectors are provided as solid-state, non-contact sensing devices. Further, in certain embodiments the detectors are provided as inductive proximity sensors that detect metal targets 60. Other proximity sensors (e.g., acoustic, capacitive, or infrared sensors), or other forms of detectors, could be used in additional embodiments. And while two detectors are described above for detecting the targets 60 shown in FIGS. 4-6, the anti-two-block sensing device 32 could have any suitable number of detectors and associated targets 60. It is noted, however, that while the sensing device 32 could have just a single detector for sensing one target 60, two or more detectors could be used for redundancy.

As noted above, the depicted anti-two-block sensing device 32 includes lifting eyes 64 for connecting the sensing device 32 in a hoisting system (e.g., suspended from the boom of the crane 12 via the chains 34). Although other embodiments may differ, the sensing device 32 in FIGS. 4-6 has multiple, interlocking layers to completely encircle the hoisting line 20 and enhance the rigidity of the overall assembly. The main body or chandelier 42 includes upper and lower plates 70 and 72. Although these components are generally depicted as plates in FIGS. 4-6, the components could be provided in other forms in different embodiments. The upper plate 70 includes an aperture 74 for receiving the hoisting line 20 and a slot 76 that allows the plate to be installed on an existing hoisting system. That is, the slot 76 allows the plate 70 to be transversely installed by moving the plate so that the hoisting line 20 passes through the slot 76 and into the aperture 74, rather than threading the hoisting line 20 through the aperture 74. The lower plate 72 includes a similar aperture 80 and slot 82, which also allows the plate 72 to be positioned about the hoisting line 20. Additionally, the depicted trigger device 44 includes upper and lower plates 90 and 92, which have hoisting line apertures 94 and 100 and slots 96 and 102 that allow transverse installation of the plates 90 and 92 about the hoisting line 20 in a manner similar to that described above. In other embodiments, the trigger device 44 could be provided in other forms, such as a solid wire or rod that partially or fully surrounds the hoisting line 20.

It will be appreciated that the ability to transversely install the plates 70,72, 90, and 92 about the hoisting line 20 enables the main body 42 and the trigger device 44 to be installed on an assembled hoisting line system (e.g., without disconnecting the hoisting line 20 from the hook assembly 28 and threading the hoisting line through each of the plates). Although no individual plate of the main body 42 and the trigger device 44 fully surrounds the hoisting line 20 (due to their slots), once positioned about the hoisting line 20 the plates may be aligned and fastened together so that their slots are offset from one another such that the plates cooperate to fully encircle the hoisting line 20. More particularly, the slots 76 and 82 are rotationally offset from one another such that the plates 70 and 72 of the main body 42 cooperate to fully surround the hoisting line 20. Similarly, the slots 96 and 102 are offset from one another so the plates 90 and 92 of the trigger device 44 also cooperate to fully surround the hoisting line 20. Further, as shown in FIGS. 4-6, the lower plate 72 includes a key 86 that is received in the slot 76 of the upper plate 70. The interlocking of the key 86 with the slot 76 facilitates proper alignment of the plates 70 and 72 and enhances rigidity of the main body 42. Also, by fully surrounding the hoisting line 20 with rigid plates, the sensing device 32 is intrinsically locked together so as to prevent inadvertent disconnection of the device 32 from the hoisting line.

In contrast to some previous anti-two-block sensing devices, in at least some embodiments of the present disclosure the sensing device 32 is devoid of seals, springs, and sliding surfaces (e.g., precision plungers) requiring periodic lubrication. Further by not using lubricants or seals, the sensing device 32 of at least some embodiments is a low-maintenance (or effectively a no-maintenance) device in that it does not require manual intervention to lubricate sliding surfaces or routinely replace parts. It can also be assembled over an intact hoisting line and still have full circumferential contact with the wire rope. Further, the operation of the sensing of the targets 60 is insensitive to the weight of the linkages suspending the trigger device 44 from the chandelier 42 in at least some embodiments.

Figure 7:
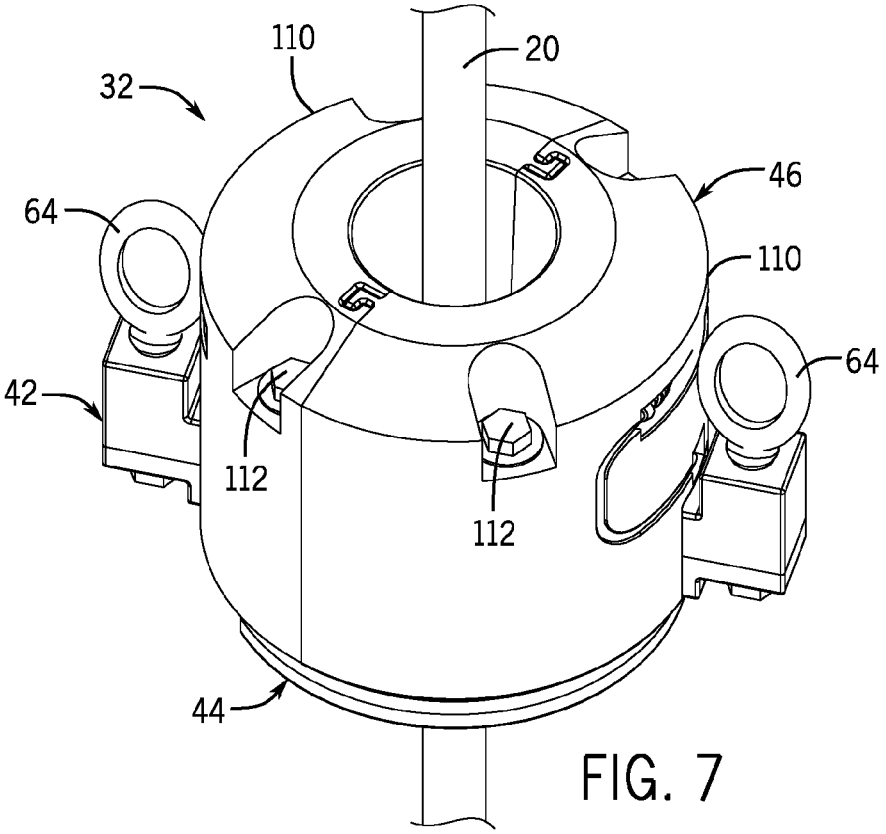
FIG. 7 is a perspective view of the sensing device of FIG. 2 positioned about a hoisting line and further shows a sensing cap having interlocking half-shells mounted on the main body in accordance with one embodiment.
Figure 8:
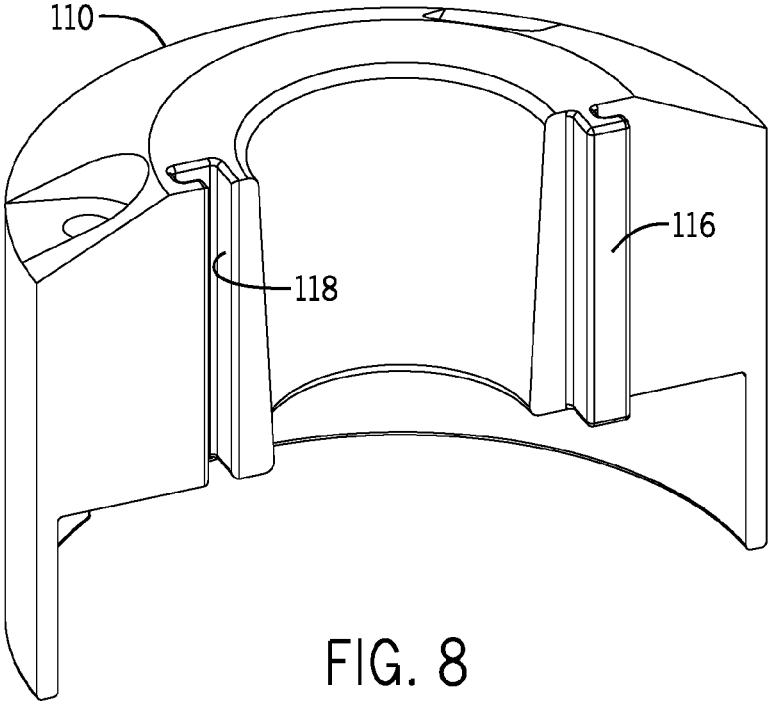
FIG. 8 is a perspective view of one of the half-shells of the cap of FIG. 7.

As noted above, the anti-two-block sensing device 32 of some embodiments includes a cap 46 coupled to the main body 42. In one embodiment generally depicted in FIG. 7, the body of the cap 46 is formed of shell portions 110 fastened to the main body 42 with fasteners 112. More specifically, the cap 46 is shown here with a half-shell interlocking design that can be assembled around the hoisting line 20 and then fastened to the main body 42. The two half-shells 110 depicted in FIG. 7 each include a key 116 and a mating slot 118, such as shown in FIG. 8. This allows the key 116 of each half-shell to be axially aligned with the slot 118 of the other so that the half-shells can be coupled by sliding the keys 116 into the slots 118. The depicted half-shells 110 are identical and can be manufactured as a single part, which will allow a manufacturer to produce and stock just one part for the cap body (rather than two different parts) and permit an operator to reduce their spare parts for the cap body by one-half. In one embodiment, the cap body is made of plastic, though other materials could be used as desired.

Figure 9:
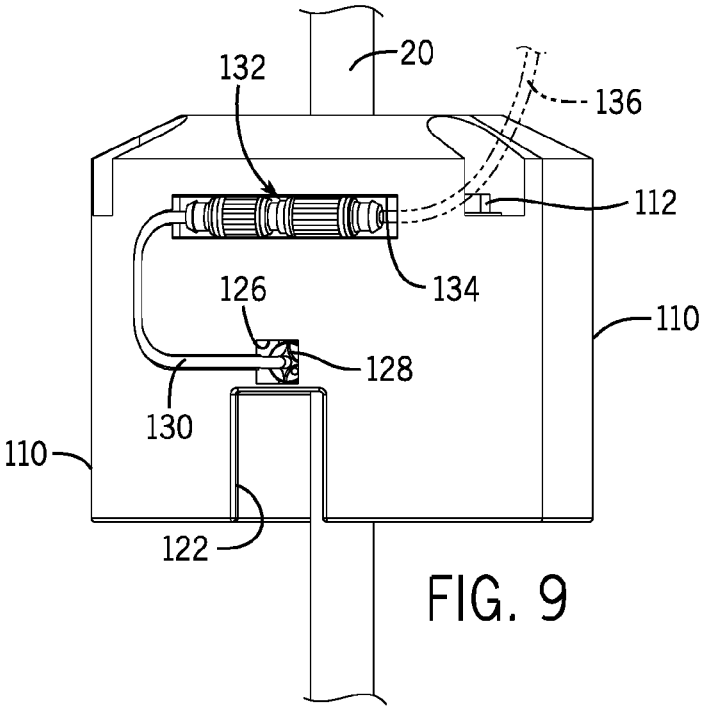
FIG. 9 is an elevational view of the sensing cap, shown without the main body and lower trigger assembly, and depicts a detector installed in the sensing cap in accordance with one embodiment.

The half-shells 110 of the cap 46 are shown assembled about the hoisting line 20 in FIG. 9 without the main body 42 or the trigger device 44 of the sensing device 32 to better show recesses 122 for mating with the main body 42. As also generally shown in this figure, the half-shells 110 include recesses 126 for receiving detectors 128 used to sense targets and facilitate avoidance of two-blocking conditions. In at least some embodiments, the detectors 128 are duplicated between the two half-shells 110 and are used with if/or logic for increased reliability. The detectors 128 can communicate with a controller in any suitable manner. In the embodiment depicted in FIG. 9, each half-shell 110 includes a cable 130 coupled to a connector assembly 132 received in a protective, snap-fit recess 134. An external cable 136 can be coupled to each connector assembly 132 to facilitate communication between the detectors 128 and a controller.

Figure 10:
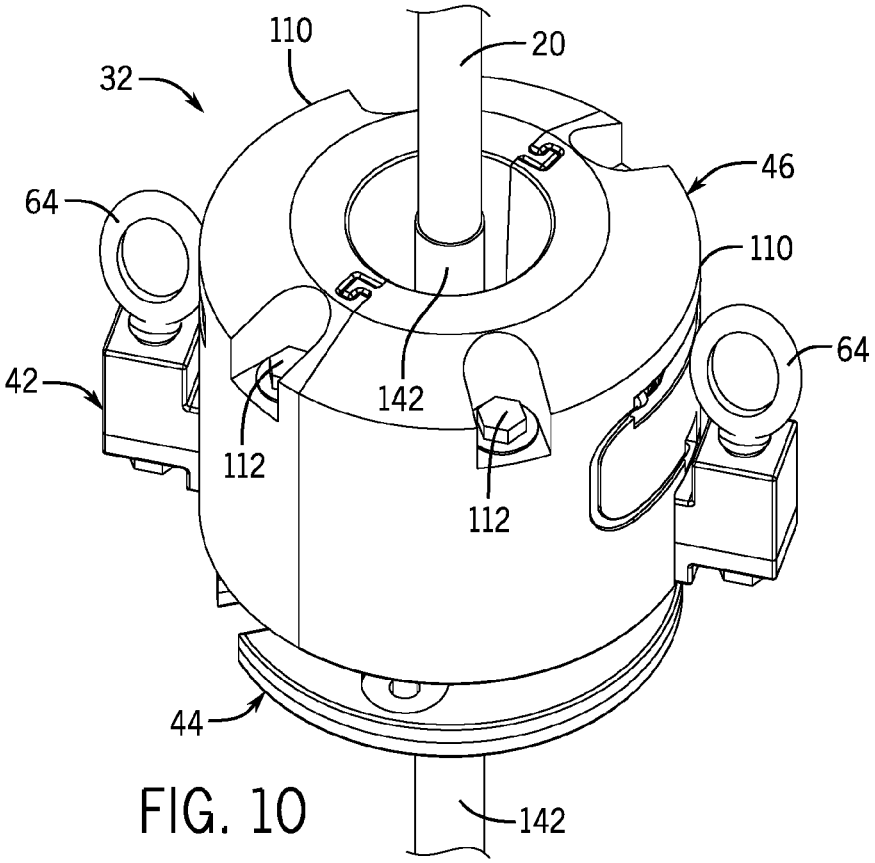
FIG. 10 depicts a hoisting line as having a sleeve that can be sensed by the cap of the anti-two-block sensing device in accordance with one embodiment.

In some instances, the detectors 128 include proximity sensors used to detect targets 60 moved through actuation of the trigger device 44, as described above. In other embodiments, however, the detectors 128 are also or instead used to sense one or more sleeve components (which may also be referred to as targets) provided on the hoisting line itself. For example, such sleeve components (e.g., a metallic material 144 (FIG. 11) or radio-frequency identification tags 164 (FIG. 13) can be embedded in a sleeve 142 positioned about the hoisting line 20 as generally shown in FIG. 10. The sleeve 142 has a layered construction designed to wrap around the circumference of the hoisting line 20 for a given length in at least some embodiments, and can have a high-visibility design to assist operators with visual location of the hook 30 and the hoisting line.

Figure 11:
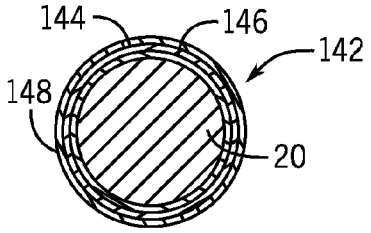
FIG. 11 is a cross-section of the sleeve of FIG. 10 in accordance with one embodiment.

As depicted in FIG. 11, the sleeve 142 includes as the sleeve component a metallic material 144 (e.g., a magnetic material) positioned between inner and outer protective, insulation layers 146 and 148. The metallic material 144 is presently depicted as a layer entirely surrounding the inner protective layer 146, although it will be appreciated that this need not be the case. In this embodiment, the detectors 128 include proximity sensors for detecting the metallic material 144 when the sleeve 142 enters the anti-two-block sensing device 32. When the detectors 128 sense the presence of the sleeve 142 in the sensing device 32 a signal may be transmitted from the detectors 128 to a control system, which may respond by altering the hoisting speed. For example, in one embodiment, the control system may activate a slowdown feature that slows the ascent of the hook (e.g., by slowing the slow the speed of the hoisting line) once the metallic material 144 is detected by the detectors 128. The ascent of the hook can then be stopped when the trigger device 44 is triggered by the actuator 36.

Figure 12:
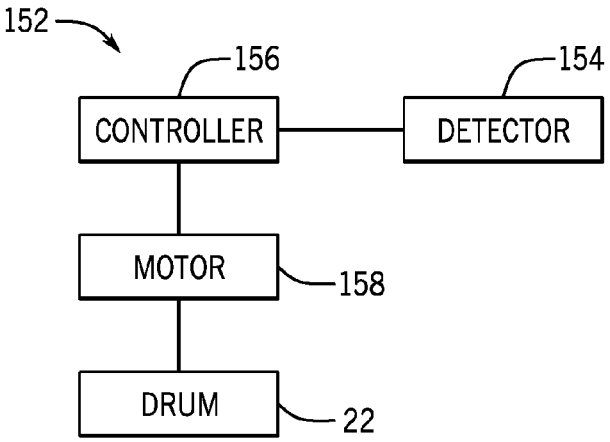
FIG. 12 is a block diagram of a control system for a crane in accordance with one embodiment.

An example of a hoisting control system 152 is generally depicted in FIG. 12 as including a detector 154, a controller 156, and a motor 158 coupled to the hoisting line drum 22. When the detector 154 (e.g., detector 128 or some other detector) senses the sleeve 142 or detects movement of the trigger device 44, the detector sends a signal to the controller 156. As generally discussed above, the controller 156 can command the motor 158 to slow down or stop reeling in of the hoisting line 20 in response to the signal sent by the detector. The controller 156 in some embodiments also controls or limits movement of a crane in response to the signal.

Figure 13:
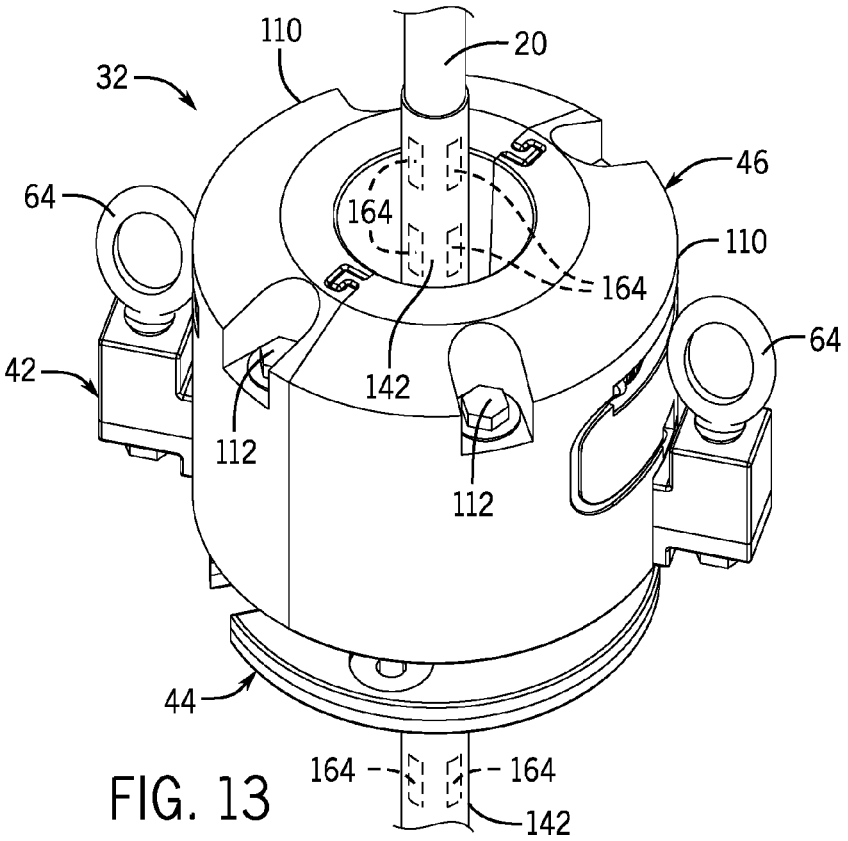
FIG. 13 depicts a hoisting line sleeve as having multiple radio-frequency identification tags to be detected with the anti-two-block sensing device in accordance with one embodiment.

In still other embodiments, the sleeve components (targets) sensed by the detectors 128 (or 154) are radio-frequency identification (RFID) tags positioned along the hoisting line 20. One example of such an embodiment is depicted in FIG. 13, in which RFID tags 164 are embedded in the sleeve 142 and the detectors 128 are provided as RFID readers. In this embodiment, the metallic layer 144 can be omitted, and the sleeve components are RFID tags 164 embedded between the protective layers 146 and 148 of the sleeve 142. As shown in the present figure, RFID tags 164 are spaced longitudinally along the hoisting line 20. In at least some instances, the RFID signatures of these tags 164 are progressively different through the longitudinal axis, providing positive location of the sleeve 142 (e.g., in reference to the strike plate or other actuator 36). As the RFID tags 164 travel up through the cap 46, the detectors of the cap 46 read the RFID tags 164 and indicate detection of the tags to the controller 156. The action to be taken by the controller 156 in response to the signals can be varied based on the RFID tag detected. For example, in some embodiments the controller activates a slowdown of an ascending hoisting line when a first RFID tag 164 is detected (e.g., a tag nearer the top of the sleeve 142) and then commands the hoisting line to stop when a second RFID tag 164 is detected (e.g., a tag closer to the bottom of the sleeve 142). In some such embodiments, the main body 42 and the trigger device 44 may be retained in the anti-two-block sensing device 32 as a backup (i.e., as a redundant stop feature). In still further embodiments, additional RFID tags 164 could be used to trigger still further functions when detected (e.g., for slowing the hoisting speed in stages before stopping).

Figure 14:
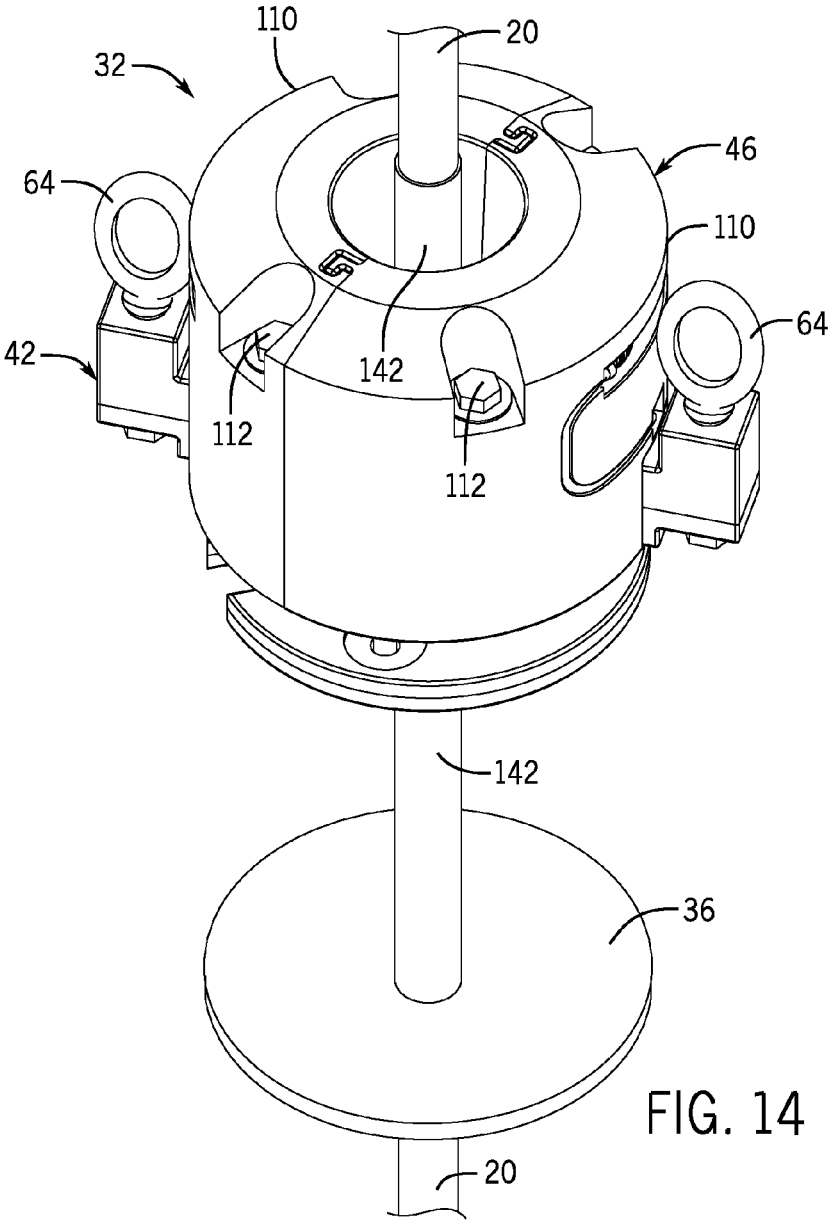
FIG. 14 depicts the hoisting line sleeve as extending upwardly from a strike plate coupled to the hoisting line in accordance with one embodiment.

The length of the sleeve 142 can be varied between different implementations. For instance, the length can vary depending on the speed or rate of travel of the hoisting line 20. In one embodiment, the sleeve 142 is placed around the hoisting line 20 extending upward from a location starting at the actuator 36 (e.g., a strike plate) located at the top of a hook ball/weight, as generally depicted in FIG. 14.

Figure 15:
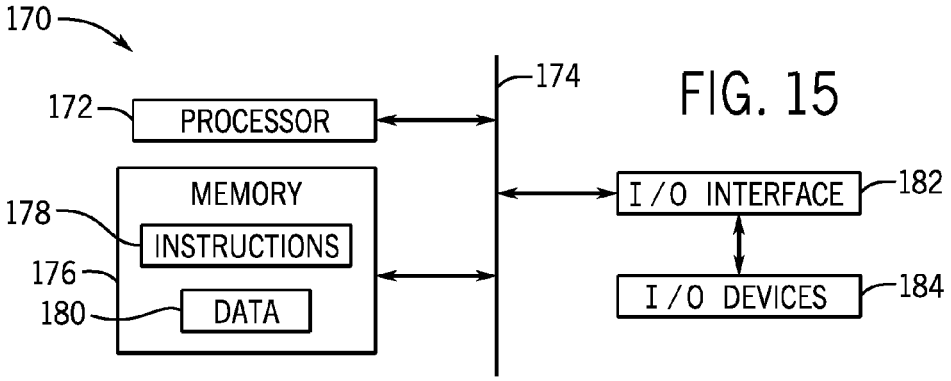
FIG. 15 is a block diagram of a controller that can be used in the control system of FIG. 13 in accordance with one embodiment.

It is noted that a controller 156 for implementing various functionality described herein (e.g., slowing or stopping hoisting in response to signals from anti-two-block sensing device 32) can be provided in any suitable form. In at least some embodiments, such a controller 156 is provided in the form of a processor-based system, an example of which is illustrated in FIG. 15 and generally denoted by reference numeral 170. In this depicted embodiment, the system 170 includes a processor 172 connected by a bus 174 to a memory device 176. It will be appreciated that the system 170 could also include multiple processors or memory devices, and that such memory devices can include volatile memory (e.g., random-access memory) or non-volatile memory (e.g., flash memory and a read-only memory). The one or more memory devices 176 are encoded with application instructions 178, such as software executable by the processor 172 to control hoisting system operation as described herein. Data 180 may also be stored in memory devices 176. In one embodiment, the application instructions 178 are stored in a read-only memory and the data 180 is stored in a writeable non-volatile memory (e.g., a flash memory). The system 170 also includes an interface 182 that enables communication between the processor 172 and various input or output devices 184 (e.g., detectors 128 or 154). The interface 182 can include any suitable device that enables such communication, such as a modem or a serial port. The devices 184 could also include an operator control panel for communicating information (e.g., warning alerts triggered by sensing of the device 32) to, and receiving input from, an operator.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a hoisting system having a hoisting line;

a sleeve positioned on the hoisting line; and an anti-two-block sensing device installed about the hoisting line so as to allow the hoisting line to move through the anti-two-block sensing device, the anti-two-block sensing device including a detector positioned to detect a sleeve component when the sleeve is present within the anti-two-block sensing device, wherein the sleeve component includes a metallic material and the detector includes a proximity switch positioned to detect presence of the metallic material within the anti-two-block sensing device.

2. The apparatus of claim 1, wherein the detector includes an inductive proximity switch.

3. The apparatus of claim 1, wherein the sleeve is wrapped around the hoisting line.

4. The apparatus of claim 1, wherein the sleeve includes inner and outer insulation layers and the sleeve component to be detected by the detector of the anti-two-block sensing device is positioned between the inner and outer insulation layers.

5. The apparatus of claim 1, wherein the anti-two-block device includes a chandelier suspended from a crane of the hoisting system and a cap that includes the detector and is mounted on the chandelier.

6. The apparatus of claim 5, comprising a trigger device suspended from the chandelier, wherein the trigger device is positioned to be contacted by an actuator coupled to the hoisting line.

7. The apparatus of claim 6, wherein the detector of the anti-two-block sensing device is positioned to detect movement of the trigger device with respect to the chandelier.

8. An apparatus comprising:

a hoisting system having a hoisting line;

a sleeve positioned on the hoisting line; and an anti-two-block sensing device installed about the hoisting line so as to allow the hoisting line to move through the anti-two-block sensing device, the anti-two-block sensing device including a detector positioned to detect a sleeve component when the sleeve is present within the anti-two-block sensing device, wherein the sleeve component includes a radio-frequency identification tag and the detector includes a radio-frequency identification reader positioned to detect the radio-frequency identification tag.

9. The apparatus of claim 8, comprising a hoisting line controller configured to change a speed of the hoisting line in response to detection of the sleeve component by the detector of the anti-two-block sensing device.

10. The apparatus of claim 9, wherein the hoisting line controller is configured to slow the speed of the hoisting line in response to detection of the sleeve component by the detector and to stop the hoisting line in response to detection of an additional sleeve component by the detector.

11. A method of operating a hoisting system comprising:

drawing a hoisting line of a hoisting system past an anti-two-block sensing device, the anti-two-block sensing device including a detector and the hoisting line including a target to be sensed by the detector;

detecting the target of the hoisting line with the detector of the anti-two-block sensing device, wherein the target includes a metallic target inside a sleeve positioned about the hoisting line, the detector of the anti-two-block sensing device includes a proximity sensor, and detecting the target of the hoisting line with the detector includes detecting the metallic target with the proximity sensor; and altering hoisting speed of the hoisting line in response to the detection of the target of the hoisting line by the detector.

12. A method of operating a hoisting system comprising:

drawing a hoisting line of a hoisting system past an anti-two-block sensing device, the anti-two-block sensing device including a detector and the hoisting line including a target to be sensed by the detector;

detecting the target of the hoisting line with the detector of the anti-two-block sensing device, wherein the target includes a radio-frequency identification tag positioned along the hoisting line, the detector of the anti-two-block sensing device includes a radio-frequency identification reader, and detecting the target of the hoisting line with the detector includes detecting the radio-frequency identification tag with the radio-frequency identification reader; and altering hoisting speed of the hoisting line in response to the detection of the target of the hoisting line by the detector.

13. The method of claim 12, wherein altering hoisting speed of the hoisting line includes reducing the hoisting speed of the hoisting line without stopping the hoisting line in response to detecting the radio-frequency identification tag with the radio-frequency identification reader.

14. The method of claim 13, comprising: detecting, with the radio-frequency identification reader, an additional radio-frequency identification tag positioned along the hoisting line; and stopping the hoisting line in response to detection of the additional radio-frequency identification tag by the radio-frequency identification reader.

15. The method of claim 14, wherein the anti-two-block sensing device includes an aperture through which the hoisting line is received, the hoisting line includes a sleeve having the radio-frequency identification tag and the additional radio-frequency identification tag, and detecting the radio-frequency identification tag and the additional radio-frequency identification tag occurs with the sleeve received in the aperture of the anti-two-block sensing device.

16. The method of claim 15, comprising detecting a further radio-frequency identification tag positioned along the hoisting line, wherein the radio-frequency identification tag, the additional radio-frequency identification tag, and the further radio-frequency identification tag are positioned at different longitudinal locations along the hoisting line.

17. The method of claim 12, wherein altering hoisting speed of the hoisting line in response to the detection of the target of the hoisting line by the detector includes reducing the hoisting speed from a higher magnitude to a lower, non-zero magnitude in response to the detection of the target.

18. The method of claim 17, comprising, after reducing the hoisting speed from a higher magnitude to a lower, non-zero magnitude in response to the detection of the target: detecting physical contact between the anti-two-block sensing device and an actuator on the hoisting line; and stopping the hoisting line in response to the detection of the physical contact between the anti-two-block sensing device and the actuator on the hoisting line.

* * * * *